US007108286B1

(12) United States Patent
Weder et al.

(10) Patent No.: US 7,108,286 B1
(45) Date of Patent: Sep. 19, 2006

(54) ANTIFALSIFICATION PAPER AND OTHER ANTIFALSIFICATION ITEMS

(75) Inventors: Christoph Weder, Gattikon (CH); Paul Smith, Zürich (CH)

(73) Assignee: Landquart, Landquart-Fabriken (CH)

( * ) Notice: Subject to any disclaimer, the term of this patent is extended or adjusted under 35 U.S.C. 154(b) by 0 days.

(21) Appl. No.: 09/787,942

(22) PCT Filed: Sep. 22, 1999

(86) PCT No.: PCT/CH99/00450

§ 371 (c)(1),
(2), (4) Date: Sep. 7, 2001

(87) PCT Pub. No.: WO00/19016

PCT Pub. Date: Apr. 6, 2000

(30) Foreign Application Priority Data

Sep. 25, 1998 (CH) ..... 1958/98

(51) Int. Cl.
*B42D 15/00* (2006.01)

(52) U.S. Cl. ..... 283/72; 430/10; 283/901; 283/91

(58) Field of Classification Search ..... 283/72, 283/82, 83, 70, 91, 901; 252/301.33; 430/10; 428/916

See application file for complete search history.

(56) References Cited

U.S. PATENT DOCUMENTS

| | | | | |
|---|---|---|---|---|
| 3,276,316 | A | 10/1966 | Makas | |
| 4,943,093 | A * | 7/1990 | Melling et al. | 283/83 |
| 5,204,038 | A | 4/1993 | Heeger et al. | |
| 5,284,364 | A | 2/1994 | Jain | |
| 5,388,862 | A * | 2/1995 | Edwards | 283/82 |
| 5,532,104 | A | 7/1996 | Goto | |
| 5,746,949 | A * | 5/1998 | Shen et al. | 252/585 |
| 6,594,062 | B1 * | 7/2003 | Weder et al. | 359/245 |

FOREIGN PATENT DOCUMENTS

| | | |
|---|---|---|
| EP | 0 342 929 A1 | 11/1989 |
| WO | WO 98/01817 | 1/1998 |

OTHER PUBLICATIONS

Christopher Weder et al. "Incorporation of Phtoluminescent Polarizers into liquid crystal Displays", Science, vol. 279, Feb. 6, 1998,pp. 835-837.*

* cited by examiner

*Primary Examiner*—Willmon Fridie, Jr.
(74) *Attorney, Agent, or Firm*—Morgan, Lewis & Bockius, LLP

(57) ABSTRACT

The present invention describes security paper and security items in general containing at least one security element having at least one photoluminescent segment characterized by a linearly polarized photoluminescence and/or a linearly polarized absorption. The present invention also describes a method of producing such security items as well as the use thereof.

26 Claims, 3 Drawing Sheets

- ○ 1 % EHO-OPPE, 485 nm
- ● 1 % EHO-OPPE, 325 nm
- □ 2 % EHO-OPPE, 485 nm
- ■ 2 % EHO-OPPE, 325 nm
- △ 1 % O-OPPE, 485 nm
- ▲ 1 % O-OPPE, 325 nm
- ◇ 2 % HMW-EHO-OPPE, 485 nm
- ◆ 2 % HMW-EHO-OPPE, 365 nm
- ✱ MEH-PPV, 510 nm

ANTIFALSIFICATION PAPER AND OTHER ANTIFALSIFICATION ITEMS

FIELD OF THE INVENTION

The present invention relates to security paper and security items in general, i.e., items whose counterfeiting is to be prevented or made difficult by one or more security elements, where the security elements have at least one photoluminescent segment. The present invention also relates to a method of producing such security items as well as a method of using same.

BACKGROUND OF THE INVENTION

It is generally known that security elements may be used for security papers and security items in general, for example, for bank notes, checks, stocks and bonds, securities, identification cards, passports, drivers licenses, admission tickets, stamps and similar documents or for bank cards, credit cards and the like, for the purpose of said security elements is to prevent or interfere with counterfeiting of these objects by unauthorized parties (R. van Renesse, Optical Document Security (1997), Artech House, Boston). Likewise, such security elements are used to identify the validity or authenticity of objects or to permit or facilitate identification of objects in general.

For example, it is a widespread practice to use security threads or strips which may consist of a metal-coated plastic, for example, in security papers, in particular for use in bank notes and similar valuable papers. If these security threads or strips are embedded in the security paper, for example, which is subsequently printed at any rate, these security elements cannot readily be seen when the object is observed in reflection. However, when light is passed through the object, these security elements appear as a dark shadow and therefore can be observed in transmission. In particular to guarantee protection against counterfeiting of security items such as security papers, many proposals have been made in recent times for providing security elements with certain properties so that not only the presence of security elements per se but also in particular the presence of specific properties should guarantee the authenticity of the object thus secured (U.S. Pat. No. 4,897,300; U.S. Pat. No. 5,118,349; U.S. Pat. No. 5,314,739; U.S. Pat. No. 5,388,862; U.S. Pat. No. 5,465,301; German Patent Application 1,446,851; British Patent 1,095,286). For example, a security thread having a multicolor micro-printing is known from German Patent Application 1,446,851; the printing ink may also be fluorescent in this case. The surfaces printed with different colors are so small or so close together in the case of this thread that they can hardly be differentiated with the naked eye and therefore appear to the observer as a single-color pattern. However, the micro-printing and the different colors can be observed with the help of a magnifying glass or a microscope. A similar security element is described in British Patent 1,095,286, where the micro-printing claimed in the aforementioned patent specification consists of characters and patterns. U.S. Pat. No. 4,897,300, however, describes a security paper in which are embedded several security threads which are printed with different luminescent dyes. In the unexcited state, the latter are colorless or the same color as the paper and therefore are difficult or impossible for the observer to see. Due to excitation, e.g., irradiation with ultraviolet (UV) light, the security threads assume a luminescence of an extent that permits detection by the naked eye. In addition, characteristic mixed colors are formed by overlapping of security threads of different colors. To further increase the security of security papers, especially bank notes, a security thread or strip of plastic is also integrated into the paper so that the "window" in the paper surface allows a direct view of parts of the surface of the security element, as described in British Patent 1,552,853, British Patent 1, 604, 463 or European Patent 0,059,056, for example.

However, one serious disadvantage of all these known security elements is that either the characteristic authenticity features are relatively difficult for a layperson to discern or they require complex equipment for detection, or on the other hand, an easily detectable authenticity feature may be counterfeited relatively easily. However, it is in the nature of the matter that security items are often replaced by newer products with newer security elements after a comparatively short period of time, in particular to prevent counterfeiting and other forms of abuse. Therefore, there has been an urgent need for new, secure and easily discernible security elements for security papers and for security items in general.

One solution that is interesting in this regard has already been described in International Patent Application WO-A-98 01817, where photoluminescence polarizers, where the emitted luminescence light is linearly polarized, are used as security elements for security objects. When this light is observed through a polarizer and the polarizer is rotated, the result for the observer is a light-dark effect because of the luminescence light which is either transmitted or not transmitted through the polarizer, depending on the rotational position. Although U.S. Pat. No. 5,284,364 uses polarizers for security purposes, they are "ordinary" polarizers such as $\lambda/2$ layers and are not photoluminescence polarizers.

SUMMARY OF THE INVENTION

One object of the present invention is to eliminate the above-mentioned disadvantages of the previously known security elements and to create security papers and other security items which are characterized by secure and easily discernible security elements. Another object of the invention is to create security papers and other security items whose identification is permitted or facilitated by such security elements or whose authenticity or validity is identified by such security elements. Additional objects of the present invention include the development of a method for producing these security items as well as the use thereof. The solution to these objects is characterized in the independent claims.

Definitions

The term security element refers in general to a shaped object, for example, which may come in a variety of forms including but not limited to fibers, threads, strips, films, sheets, layers, tapes, sheets, disks, chips and/or combinations thereof. The security element may be homogeneous and continuous and may be structured or patterned and may contain several individual elements, zones or pixels.

The term security item refers to objects whose counterfeiting is to be prevented or made difficult by one or more security elements or whose authenticity or validity is to be identified by means of one or more security elements or which are to be identified by one or more security elements including but not limited to bank notes, checks, stocks and bonds, securities, identification cards, passports, drivers licenses, admission tickets, stamps, bank cards and credit cards. The term security paper refers to security items made essentially of paper.

To describe the functioning and properties of segments, security elements, security items and the conditions of experiments, the following conventional definitions of different axes are used here:

The polar axis of a linear polarizer or analyzer is the direction of the electric field vector of the light transmitted through the polarizer or analyzer. The polarization axis of a segment or security element of another object, if applicable accordingly, is the direction of the electric field vector of the light emitted or absorbed by the corresponding segment, security element or other object.

A segment is understood in the present patent specification to refer to a portion of an object, in particular a security element on which the characteristic degree of polarization and the polarization axis for emission and absorption can be determined in an adequate manner.

The degree of polarization for the emission is expressed in this patent specification by the dichroic ratio in emission. The dichroic ratio in emission is defined as the ratio of the integrated photoluminescence of emission spectra measured with unpolarized excitation by a linear polarizer whose polar axis is parallel and normal to the polarization axis of the segment investigated.

The degree of polarization for the absorption is expressed in this patent publication by the dichroic ratio in absorption. The dichroic ratio in absorption is defined as the ratio of absorption measured at the excitation wavelength by a linear polarizer (analyzer) whose polar axis is parallel and normal to the polarization axis of the segment investigated.

The excitation wavelength is defined in this patent specification as the wavelength used for optical excitation to photoluminescence of the security element or its photoluminescent segments. The terms absorption and emission refer to optical processes.

Figure 1:
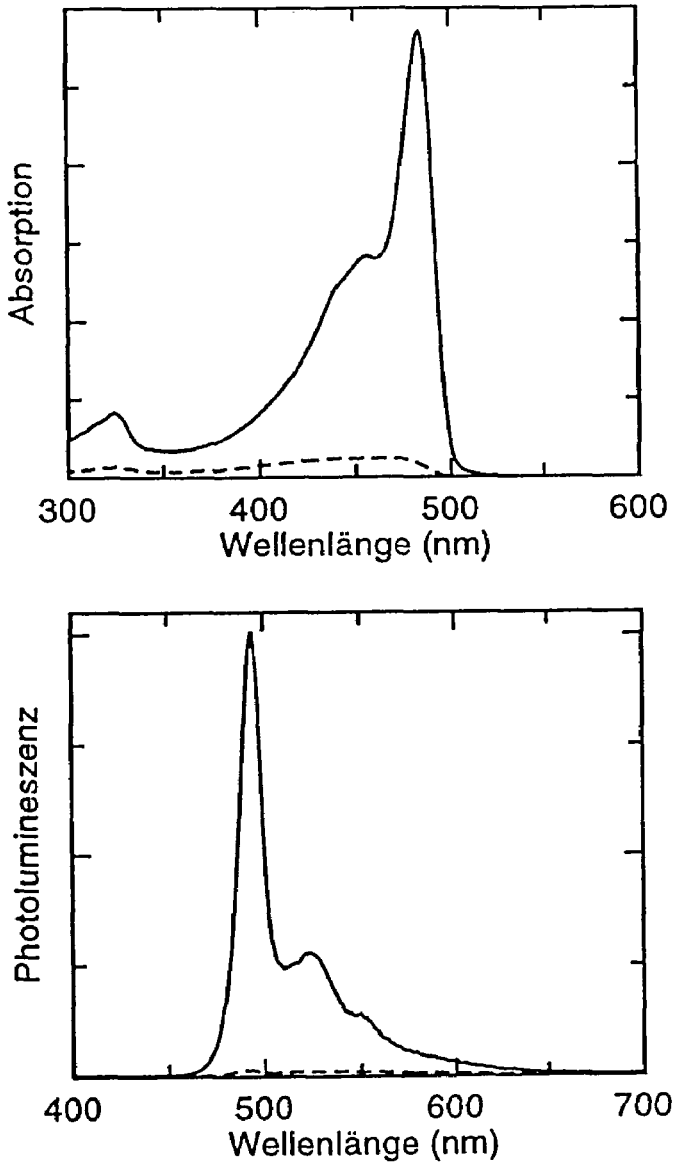
FIG. 1.

Dichroic properties of a film of 2 percent by weight EHD-OPPE/UHMW-PE with a drawing rate of 80 (referred to as material A in the following examples). Top: polarized absorption spectra recorded for incident light polarized parallel (solid line) and normal (dotted line) to the polarization axis of the film. Bottom: polarized emission spectra under isotropic excitation at 365 nm, measured by a polarizer (analyzer) with its polar axis parallel (solid line) and normal (dotted line) to the polarization axis of the film.

FIG. 2:

Graphic plot of the dichroic ratio in absorption and the dichroic ratio in emission for a series of previously known photoluminescent materials with linearly polarized emission and linearly polarized absorption; these materials are suitable in part for use in security elements according to the present invention, plotted as a function of the drawing rate (shown in the graph), composition and chemical structure of the luminescent dye.

FIG. 3:

Simplified graphic plot of security items according to the present invention.

DETAILED DESCRIPTION OF THIS INVENTION

The present invention is based on our surprising discovery that security elements which can be used for production of security papers and security items in general can be fabricated from photoluminescent materials which are characterized by a linearly polarized photoluminescence or linearly polarized absorption or both and can be converted to a form according to this invention. In particular, we have discovered that the security papers and security items in general according to this invention are characterized by a great security against counterfeiting and easily discernible authenticity features.

The fact that certain luminescent materials have a linearly polarized absorption and emission behavior has been known per se for a long time. These effects were first observed in inorganic crystals (E. Lommel, Ann. d. Physik und Chemie, Vol. 8, pp. 634–640 (1879)) and later in oriented films of mixtures of ductile polymers and luminescent dyestuffs (A. Jablonski, Acta Phys. Polon., Vol. A 14, pp. 421–434 (1934)). Since then, numerous materials characterized by linearly polarized absorption and emission have become known (J. Michl et al. Spectroscopy with Polarized Light (1986) VCH Publishers, New York), such as oriented mixtures of ductile polymers and oligomeric photoluminescent materials with a significantly uniaxial component (M. Hennecke et al., Macromolecules, Vol. 26, pp. 3411–3418 (1993)), oriented photoluminescent polymers (P. Dyreklev et al., Adv. Mat., Vol. 7, pp. 43–45 (1996)) or mixtures of photo luminescent and ductile polymers (U.S. Pat. No. 5,204,038; T. W. Hagler et al., Polymer Comm., Vol. 32, pp. 339–342 (1991); Ch. Weder et al., Adv. Mat., Vol. 9, pp. 1035–1039 (1997)), liquid crystal in systems (N. S. Sariciftci et al., Adv. Mater., Vol. 8, p. 651 (1996); G. Lüssem et al., Adv. Mater., Vol. 7, P. 923 (1995)) or oriented photoluminescent materials grown on orienting substrates (K. Pichler et al., Synth. Met., Vol. 55–57, p. 454 (1993); N. Tanigaki et al., Mol. Cryst. Liq. Cryst., Vol. 267, p. 335 (1995); G. Lüssem et al., Liq. Cryst., vol. 21, p. 903 (1996); R. Gill et al., Adv. Mater., vol. 9, pp. 331–334 (1997)). Only recently have photoluminescent materials having an essentially unpolarized absorption behavior but a linearly polarized emission have also been described (C. Weder et al., Nature, vol. 392, p. 261; European Patent Application 98101520.9). Likewise, photoluminescent materials having a linearly polarized absorption and an essentially unpolarized emission have also been obtained (European Patent Application 97111229.7; European Patent Application 98101520.9).

According to the present invention, such materials can be brought into a suitable form and used to produce security elements from which security papers and security items can be fabricated. The security element may be embodied in a wide variety of forms, including but not limited to fibers, threads, strips, films, sheets, layers, tapes, sheeting, disks, chips and/or combinations thereof. In addition, security elements may also be used in more complex forms including but not limited to logos, letters, characters, numerals, etc. In addition, the surface of the security element may be structured, for example, by printing or embossing. The essential feature of the security items according to the present invention is that the security element has at least one photoluminescent segment which is characterized by a linearly polarized photoluminescence and/or a linearly polarized absorption, or the security element has at least one segment characterized by a linearly polarized absorption.

In the case of photoluminescent segments, it may be advantageous if little or none of the excitation is provided by normal daylight but instead, according to a preferred embodiment of the present invention, an additional light source such as light in the UV range is needed to make the photoluminescence visible. The linearly polarized photoluminescence of such segments then leads to the emitted light being absorbed to different extents by an external polarizer (analyzer), depending on the orientation of the polar axis of the polarizer (analyzer) and the polarization axis of the segment, which can lead to a strong light/dark contrast which can be perceived by the naked eye (and of course also by the polarizer). Naturally, this effect may also be detected with suitable sensors. Likewise, the linearly polarized absorption of such segments leads to the result that linearly polarized excitation light, which may be produced by an external light source in combination with a linear polarizer, for example, is absorbed to different extents by the segment, depending on the orientation of the polarization axis of the segment and the polarization direction of the excitation light, which can lead to a strong contrast between light and dark when observed with the naked eye. In this patent specification, a segment is a portion of an object, in particular a security element, on which the characteristic degree of polarization for emission and absorption can be determined in an adequate manner. It should be obvious for those skilled in the art that the shape and size of these segments may vary from one case to the next and that the polarization measurements can be performed with a wide variety of different experimental arrangements such as conventional spectrometers, microscopic methods, etc. For example, if a uniaxially oriented film of material A with the dimensions 5 cm×5 cm×2 μm (see example A) is used as the security element, the entire film may optionally be regarded as a segment if the measurement of the degree of polarization may be performed essentially at any point, but basically comparable results with regard to the degree of polarization or the polarization axis can be obtained within the context of measurement accuracy and production accuracy. On the other hand, a fiber shaped into a circle, for example, with a diameter of 0.5 mm, and a length of 20 cm of the same material may be regarded as a combination of many segments because the polarization axis determined from polarization measurements in this case has a strong dependence on position. Of course, this element also has optical effects similar to those described above in the sense of this invention and can be described as a combination of individual segments.

The security elements in security items according to the present invention contain a luminescent dye or several luminescent dyes in a suitable manner to induce the polarization properties according to the present invention. Suitable photoluminescent dyes include, for example, those described in European Patent Applications 97111229.7 and 98101520.9 and the publications and patents cited in these patent applications. As shown by the following experiments, certain oligomers and polymers such as poly (2,5 dialkoxy-p-phenylene-ethynylene) derivatives such as EHO-OPPE and O-PPE or poly(p-phenylene-vinylene) derivatives such as (poly-2-methoxy-5-[2N-ethylhexyloxy]-p-phenylene-vinylene) (MEH-PPV) are very useful for preferred variants of the present invention:

EHO-OPPE

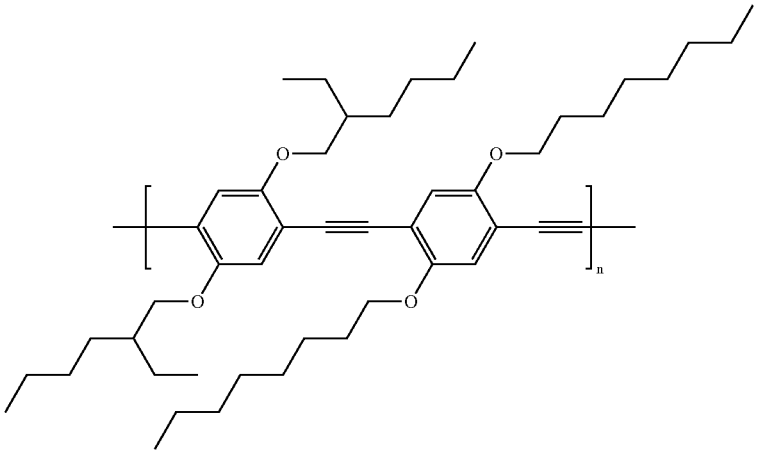

MEH-PPV

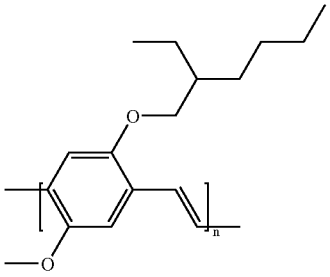

-continued

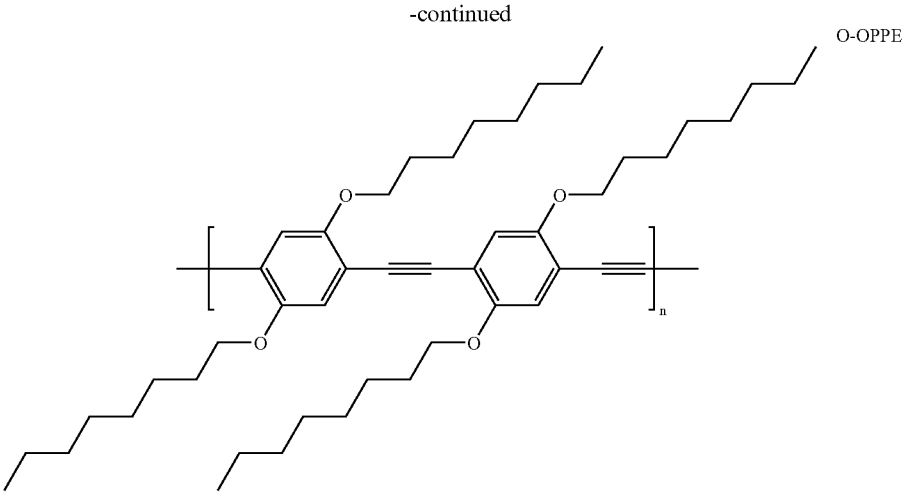

Suitable methods of producing security elements for use according to the present invention are described, for example, in European Patent Applications 97111229.7 and 98101520.9 and in the publications and patents cited in those patent applications. As shown by the following experiments, the security elements or segments of such security elements used in security items according to the present invention may be produced by anisotropic deformation of ductile mixtures, for example.

It should be readily apparent for those skilled in the art that countless embodiments of the security papers and other security items according to the present invention are possible. The idea on which the present invention is based can be applied fundamentally but not exclusively to all previously known security items and security papers having at least one security element comparable to that of the present invention, apart from the linearly polarized photo luminescence, absorption or both, of course. For example, according to a preferred embodiment of the present invention, security papers in which one or more photoluminescent security fibers or strips having properties according to the present invention have been embedded can be produced according to the present invention. If several such security fibers or strips are used, they may also have different emission colors and may be inserted into certain patterns e.g., in a specific arrangement of the polarization axes according to a preferred variant of the present invention. Similarly, the security elements may also be applied to a substrate such as one made of paper or plastic by lamination, for example. In another preferred embodiment according to the present invention, the security elements are incorporated into the substrate in the form of fibers or they are applied to the substrate. In this variant, the use of security elements having different emission colors may also be advantageous, and the fibers may have a wide variety of forms, e.g., they may be drawn or curved fibers which can lead to different optical effects according to the present invention.

This invention is explained below in greater detail on the basis of a few examples.

EXAMPLE A

Outside the Scope of the Present Invention

Production of Suitable Luminescent Dyes

The above-mentioned polymers EHO-OPPE, O-OPPE and MEHPPV were produced on the basis of the procedures described by Ch. Weder (Macromolecules (1996) Vol. 29, p. 5157), D. Steiger (Macromol. Rapid Commun. (1997) Vol. 18, p. 643) and U.S. Pat. No. 5,204,038. Two different EHO-OPPE samples with number-average molecular weights Mn of 10,000 g/mol-1 and 84,000 g/mol-1 (HMW-EHO-OPPE) were used. O—OPPE had an Mn of 10,000 g/mol-1 and MEH-PPV had a weight-average molecular weight Mw of approximately 450,000 g/mol-1.

Other Materials Used

Ultra-high molecular weight polyethylene (UHMW-PE, Hostalen Gur 412, weight-average molecular weight 4.106 g/mol-1, Hoechst A G) was used as the carrier polymer. Xylene (ultra-high purity, Fluka A G) was used as the solvent.

Characterization of the Security Elements, Segments and Materials for Security Elements:

The anisotropic photophysical behavior of the security elements, segments and materials used for the security elements was determined by polarized photoluminescence and UV/VIS spectroscopy as described in detail in European Patent Application 98101520.9 by the present applicant.

Production of Suitable Photoluminescent Materials with a Polarized Emission and Linearly Polarized Absorption:

Photoluminescent materials with 1 or 2 percent by weight EHD-OPPE with Mn of 10,000 g/mol-1 as the luminescent dye and UHMW-PE as the carrier polymer were produced as described previously (Ch. Weder et al., *Adv. Mat.*, vol. 9, pp. 1035–1039 (1997)) by pouring a solution containing the luminescent dye (5 or 10 mg) and UHMW-PE (0.5 g) in xylene (50 g) into a petri dish with a diameter of 11 cm. The resulting gels were dried under ambient conditions for 24 hours, resulting in unoriented EHO-OPPE/UHMW-PE films with a thickness of approximately 70 μm. These films were drawn at temperatures of 90–120 C to different drawing rates (=length of the drawn film/original length of the film) between 10 and 80. The resulting film had a thickness between 1 and approximately 10 μm.

This experiment was repeated with EHO-OPPE with Mn of 84,000 g/mol-1, O-OPPE with Mn of 10,000 g/mol-1 and MEH-PPV with Mw of 450,000 g/mol-1.

Figure 2:
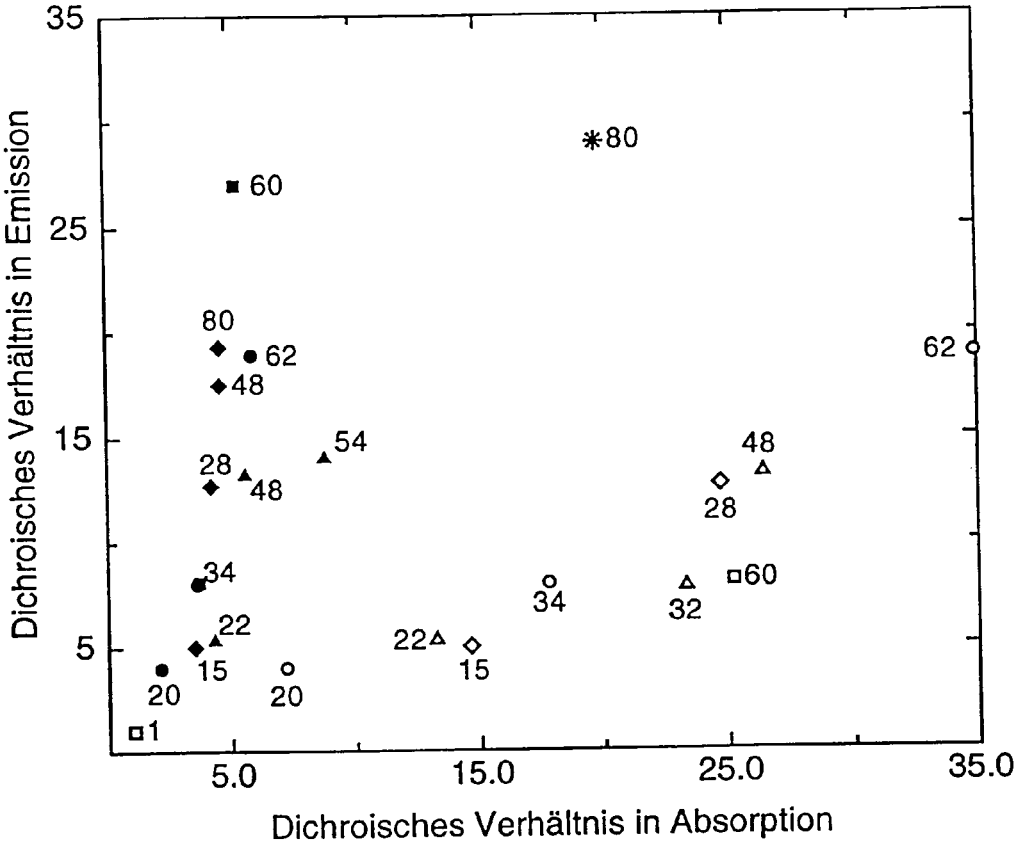

The highly drawn samples from this example had a strongly polarized absorption and strongly polarized emission, as shown in FIG. 1 for a film of 2 percent by weight EHO-OPPE with a drawing rate of 80. This specific material (referred to as material A in the following examples) has a dichroic ratio in absorption of 57 (measured at an excitation wavelength of 485 nm), a dichroic ratio in emission of 27 and a yellowish green emission color. However, a similar film of 1 percent by weight MEH-PPV with a drawing rate of 80 (referred to as material B in the following examples) has a dichroic ratio in absorption of 21, a dichroic ratio in emission of 27 (measured at an excitation wavelength of 510 nm) and a reddish orange emission color. The effects of the drawing rate, the structure of the luminescent dye, the composition of the material and the excitation wavelength on the dichroic absorption and emission properties are summarized in FIG. 2. This example thus illustrates how suitable photoluminescent materials with linearly polarized emission and linearly polarized absorption, from which security elements or segments of such security elements can be produced, can be used in security items according to the present invention.

EXAMPLE 1

Figure 3:
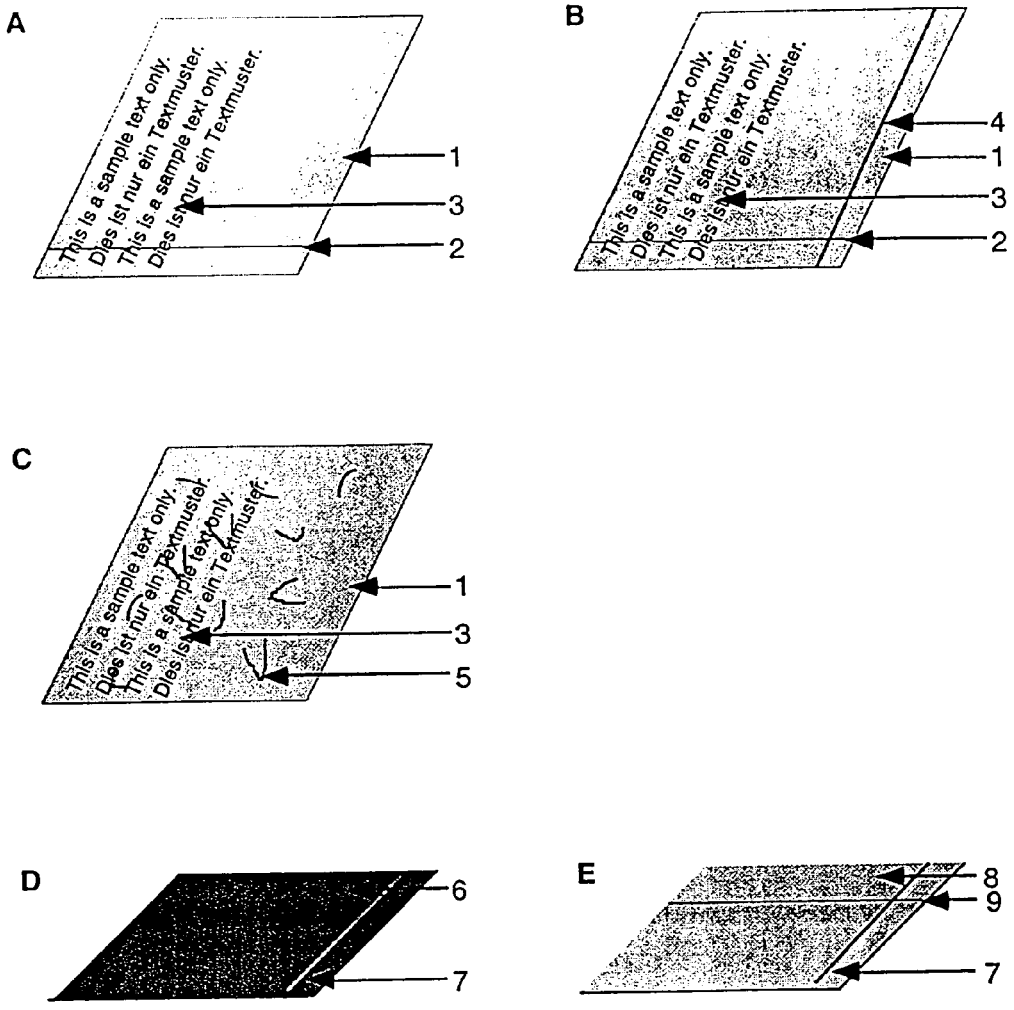

A security paper was produced by embedding a strip of material A 2 1 mm wide and approximately 2 μm thick in a paper 1 having the dimensions 17 cm×7 cm such that the polarization axis of the strip was parallel to the short sides of the paper (FIG. 3*a*). The paper 1 was printed 3, and the strip 2 could not be seen well with the naked eye either in normal daylight or in normal room light, in reflection or in transmission. However, the greenish yellow photoluminescence of the strip 2 could be detected immediately with the naked eye if the security paper was observed under a UV lamp (Bioblock, VL-4LC, 4 watts). When the security paper was observed under such light by means of an external linear polarizer (Polaroid HN32) and was rotated so that its polar axis was oriented either parallel or perpendicular to the short side of the paper 1, a strong contrast between light and dark could be seen with the naked eye in the photoluminescence of the strip 2. A similar effect was obtained when the light of the UV lamp was polarized with a polarizer (Polaroid HNP-B) and the polarizer was rotated so that its polar axis was either parallel or perpendicular to the short side of the paper 1.

EXAMPLE 2

Example I was repeated, but in addition a second strip of material B 4 1 mm wide and approximately 2 μm thick was also embedded in the paper I such that the polarization axis of this strip 4 was parallel to the long sides of the paper 1 (FIG. 3*b*). The paper I was printed 3 and the strips 2 and 4 could not be discerned well with the naked eye either in normal daylight or in normal room light, in reflection or in transmission. However, the greenish yellow and reddish orange photo luminescence of the two strips 2 and 4 could be detected immediately with the naked eye when the security paper was observed under a UV lamp (Bioblock, VL-4LC, 4 watts). When the security paper was observed under such light through an external linear polarizer (Polaroid HN32) and this was rotated so that its polar axis was either parallel or perpendicular to the short side of the paper 1, a strong contrast between light and dark could be discerned with the naked eye in the photoluminescence of the two strips 2 and 4, and essentially either the photoluminescence of the greenish yellow 2 or reddish orange 4 strips was visible. A similar effect was obtained when the light of the UV lamp was polarized with a polarizer (Polaroid HNP-B) which was rotated so that its polar axis was either parallel or perpendicular to the short side of the paper 1.

EXAMPLE 3

Example 1 was repeated, but instead of the strip, fibers of material A 5 with a diameter between approximately 30 and 400 μm and a length between approximately 1 and 10 mm were embedded in the paper 1 (FIG. 3*c*). The paper 1 was printed 3 and the fibers 5 could not be seen well with the naked eye either in normal daylight or in normal room light, either in reflection or in transmission. However, the greenish yellow photoluminescence of the fibers could be detected immediately with the naked eye when the security paper was observed under a UV lamp (Bioblock VL-4LC, 4 watts). When the security paper was observed under such light through an external linear polarizer (Polaroid HN32) which was rotated, a strong contrast could be discerned between light and dark in the photoluminescence of each individual fiber 5. A similar effect was obtained when the light of the UV lamp was polarized with a polarizer (Polaroid HNP-B) which was rotated.

EXAMPLE 4

A security card was produced by laminating a strip of material A 7 0.5 mm wide and approximately 2 μm thick onto a transparent card 6 made of yellow-pigmented PVC with the dimensions 8 cm×5 cm, such that the polarization axis of the strip 7 was oriented parallel to the short sides of the card 6 (FIG. 3*d*). The strip 7 could not be discerned well with the naked eye either in normal daylight or in normal room light. However, the greenish yellow photoluminescence of the strip V could be discerned immediately with the naked eye when the card was observed under a UV lamp (Bioblock VL-4LC, 4 watts). When the card 6 was observed through an external linear polarizer under this light and the polarizer was rotated so that its polar axis was either parallel or perpendicular to the short side of the card 6, a strong contrast between light and dark in the photoluminescence of the strip 7 could be discerned with the naked eye.

EXAMPLE 5

Example 4 was repeated, but instead of transparent card 6 made of yellow-colored PVC, a transparent card made of polycarbonate 8 was used, and in addition a second strip of material B 9 0.5 mm wide and approximately 2 pm thick was laminated to it such that the polarization axis of this second strip 9 was oriented parallel to the long sides of the card 8 (FIG. 3*e*). The greenish yellow and reddish orange photoluminescence of the two strips 7 and 9 could be detected immediately with the naked eye when the card 8 was observed under a UV lamp (Bioblock VL-4LC, 4 watts).

When the card 8 was observed through an external linear polarizer (Polaroid HN32) under this light and the polarizer was rotated so that its polar axis was either parallel or perpendicular to the short side of the card 8, a strong contrast between light and dark could be discerned with the naked eye in the photoluminescence of the two strip 7 and 9, and essentially either the photoluminescence of the greenish yellow strips 7 or the reddish orange strip 9 was visible. A similar effect was obtained when the light of the UV lamp was polarized with the polarizer (Polaroid HNP-B) and the polarizer was rotated so that its polar axis was either parallel or perpendicular to the short side of the card 8.

The invention claimed is:

1. A security item comprising at least one security element having at least one photoluminescent segment with a linearly polarized photoluminescence, wherein the segment has a dichroic ratio of 5 or more in emission, and wherein apart from the security element, the security item contains one or more synthetic polymers.

2. The security item of claim 1, wherein the security element is in a form selected from a group consisting of fibers, threads, strips, films, sheets, layers, tapes, plates, disks, chips and/or combinations thereof.

3. The security item of one of claims 2 and 1, wherein apart from the security element, the security item consists mainly of paper.

4. The security item of claim 1, wherein the security item is in a form selected from a group consisting of bank notes, checks, stocks, bonds, securities, identification cards, passports, drivers licenses, admission tickets, stamps, bank cards and credit cards.

5. A security item comprising at least one security element having at least one photoluminescent segment with a linearly polarized photoluminescence, wherein the segment has a dichroic ratio of 5 or more in emission, and wherein the security element includes at least one carrier polymer and one luminescent dye.

6. The security item of claim 5, wherein the security element can be excited to luminescence by irradiation with electromagnetic radiation at a wavelength between 200 and 400 nm.

7. The security item of claim 5, wherein the luminescent dye is at least one partially conjugated polymer.

8. The security item of claim 5, wherein the luminescent dye is a poly-p-phenylene-ethynylene derivative.

9. The security item of claim 5, wherein the security element is in a form selected from a group consisting of fibers, threads, strips, films, sheets, layers, tapes, plates, disks, chips and/or combinations thereof.

10. The security item of one of claims 5 and 9, wherein apart from the security element, the security item consists mainly of paper.

11. The security item of one of claims 5 and 9, wherein apart from the security element, the security item contains one or more synthetic polymers.

12. The security item of claim 5, wherein the security item is in a form selected from a group consisting of bank notes, checks, stocks, bonds, securities, identification cards, passports, drivers licenses, admission tickets, stamps, bank cards and credit cards.

13. The security item of claim 5, wherein the security item is configured to protect an item from counterfeiting and/or for identification of authenticity and/or validity.

14. A security item comprising at least one security element having at least one photoluminescent segment with a linearly polarized absorption, wherein the segment has a dichroic ratio of 10 or more in absorption, and wherein the security element can be excited to luminescence by irradiation with electromagnetic radiation at a wavelength between 200 and 400 nm.

15. The security item of claim 14, wherein the security element includes at least one carrier polymer and one luminescent dye.

16. The security item of claim 15, wherein the luminescent dye is at least one partially conjugated polymer.

17. The security item of claim 15, wherein the luminescent dye is a poly-p-phenylene-ethynylene derivative.

18. The security item of claim 14, wherein the security element is in a form selected from a group consisting of fibers, threads, strips, films, sheets, layers, tapes, plates, disks, chips and/or combinations thereof.

19. The security item of claim 14, wherein apart from the security element, the security item consists mainly of paper.

20. The security item of claim 14, wherein apart from the security element, the security item contains one or more synthetic polymers.

21. The security item of claim 14, wherein the security item is configured to protect an item from counterfeiting and/or for identification of authenticity and/or validity.

22. A security item comprising at least one security element having at least one photoluminescent segment with a linearly polarized absorption, wherein the segment has a dichroic ratio of 10 or more in absorption, and wherein the security element includes at least one carrier polymer and one luminescent dye.

23. The security item of claim 22, wherein the security element can be excited to luminescence by irradiation with electromagnetic radiation at a wavelength between 200 and 400 nm.

24. The security item of claim 22, wherein the luminescent dye is at least one partially conjugated polymer.

25. The security item of claim 22, wherein the luminescent dye is a poly-p-phenylene-ethynylene derivative.

26. The security item of one of claims 14 and 22, wherein the security item is in a form selected from a group consisting of bank notes, checks, stocks, bonds, securities, identification cards, passports, drivers licenses, admission tickets, stamps, bank cards and credit cards.

* * * * *